US008978185B1

(12) United States Patent
Holbrook et al.

(10) Patent No.: US 8,978,185 B1
(45) Date of Patent: Mar. 17, 2015

(54) MATTRESS PAD OR MATTRESS TOPPER WITH AN OVAL SUPPORT PORTION

(71) Applicant: Standard Fiber LLC, Burlingame, CA (US)

(72) Inventors: Russ Holbrook, Matthews, NC (US); Chun Leung Chan, Burlingame, CA (US)

(73) Assignee: Standard Fiber LLC, Burlingame, CA (US)

( * ) Notice: Subject to any disclaimer, the term of this patent is extended or adjusted under 35 U.S.C. 154(b) by 0 days.

(21) Appl. No.: 14/323,491

(22) Filed: Jul. 3, 2014

(51) Int. Cl.
*A47C 27/18* (2006.01)
*A47C 20/02* (2006.01)
*A47C 31/10* (2006.01)

(52) U.S. Cl.
CPC ..... *A47C 20/026* (2013.01); *A47C 31/105* (2013.01)
USPC ..... 5/731; 5/735

(58) Field of Classification Search
CPC ... A47C 27/001; A47C 27/026; A47C 27/027
USPC ..... 5/691, 731, 733, 735
See application file for complete search history.

(56) References Cited

U.S. PATENT DOCUMENTS

| | | | | | |
|---|---|---|---|---|---|
| 1,045,228 | A * | 11/1912 | Weltmer | ..... | 5/500 |
| 4,791,687 | A * | 12/1988 | Iwase | ..... | 5/708 |
| 5,117,519 | A * | 6/1992 | Thomas | ..... | 5/500 |
| 5,224,226 | A * | 7/1993 | Groenewald | ..... | 5/733 |
| 5,797,153 | A * | 8/1998 | Amioka | ..... | 5/632 |
| 7,444,702 | B2 * | 11/2008 | Fogg | ..... | 5/691 |
| 7,685,664 | B2 * | 3/2010 | Stolpmann et al. | ..... | 5/731 |

* cited by examiner

*Primary Examiner* — Michael Trettel
(74) *Attorney, Agent, or Firm* — Levenfeld Pearlstein, LLC

(57) ABSTRACT

A mattress pad or topper is provided. The mattress pad or topper includes a main body having a length, an upper surface, a lower surface and a peripheral surface. The main body includes a gusset portion having an arcuate profile at the upper surface defining a support portion, and at least one adjoining portion adjoined to the gusset portion. The upper surface at the arcuate profile projects beyond the upper surface at the adjoining portion.

10 Claims, 2 Drawing Sheets

MATTRESS PAD OR MATTRESS TOPPER WITH AN OVAL SUPPORT PORTION

BACKGROUND

The following description relates to a mattress pad or topper, and in particular, a mattress pad or topper having an oval support portion.

A mattress topper or pad is configured for fitting on or over a mattress. A mattress topper or pad may include a padded surface configured for positioning on top of a mattress so that a user may lie on the padded surface. The mattress topper or pad may also include four sides or straps depending from the padded surface, the fours sides or straps configured to fit around corresponding sides or corners of the mattress to hold the mattress pad or topper in place.

The padded surface may be formed by inserting a padding material between first and second layers of fabric or other material. The padded surface may be stitched into a boxed pattern. The padding material may be used to provide either a soft or firm feel for the user lying on the padded surface. For example, the padding material may be soft material, which may provide additional cushioning or padding on a firm mattress. Alternatively, the padding material may be firmer material that can add firmness or support to a softer mattress.

In addition, for further comfort or support, a user may incorporate additional items. For example, the user may seek additional support to, for example, maintain spinal alignment. Currently, a user may use a pillow or pillows for this purpose, and place the pillow or pillows under their head, neck, or torso.

However, it may be difficult for a user to position the pillow or pillows in a desired manner, and maintain the desired position while they are sleeping. In addition, it may be difficult for the user to move without having to reposition the pillow or pillows. Further still, additional support items may lose their shape, and thus, their supporting properties, during use. Even further, because the pillow or other additional support portions may closely contact and/or support a portion of the user, the user may experience uncomfortable temperatures due to lack of air flow between the user and the pillow or other support portion.

Accordingly, it is desirable to provide a mattress pad or mattress topper having a support portion forming a contoured surface configured to support a desired portion of the user's body.

SUMMARY

According to one aspect, there is provided a mattress pad or topper including a main body having a length, an upper surface, a lower surface and a peripheral surface. The main body includes a gusset portion having an arcuate profile at the upper surface defining a support portion and at least one adjoining portion adjoined to the gusset portion, wherein the upper surface at the arcuate profile projects beyond the upper surface at the adjoining portion.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
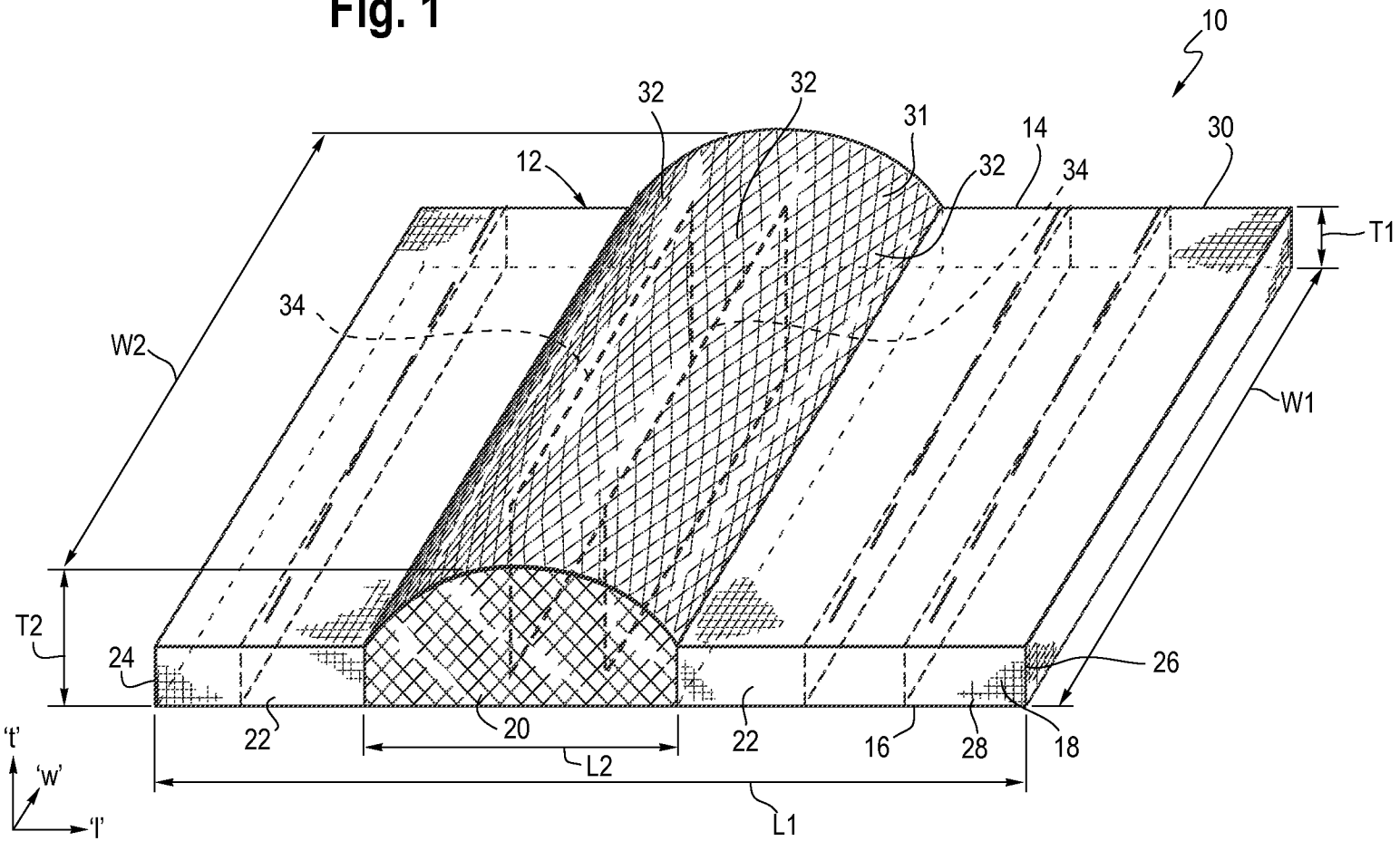
FIG. 1 is perspective view of an example of a mattress pad or topper according to an embodiment disclosed herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is perspective view of an example of a mattress pad or mattress topper 10 according to an embodiment disclosed herein. Referring to FIG. 1, a mattress pad or mattress topper 10 includes a main body 12. The main body 12 extends in a length direction '1', a width direction 'w' and a thickness direction T and is formed having a first length L1 in the length direction '1', a first width W1 in the width direction 'w' and a first thickness T1 in the thickness direction.

The main body 12 also includes an upper surface 14 configured for positioning of a user thereon, a lower surface 16 opposite to the upper surface 14, configured for positioning adjacent to or abutting a mattress, a peripheral surface 18 extending about a periphery of the main body 12 between the upper surface 14 and lower surface 16. A padding material (not shown) may be received between the upper surface 14 and the lower surface 16. The upper surface 14 may be formed as a layer or layers of at least one material. Similarly, the lower surface 16 may be formed as a layer or layers of at least one material. The peripheral surface 18 may be formed as a strip of material extending between the upper surface 14 and lower surface 16, having one side or edge stitched or otherwise fastened to the upper surface 14 and another side or edge stitched or otherwise fastened to the lower surface 16. Alternatively, the upper surface 14 and lower surface 16 may be stitched or otherwise fastened directly to each other. In this configuration, that peripheral surface 18 may be formed by a portion of one of or both of the upper surface 14 and lower surface 16. A padding material may be interposed between the upper surface 14 and the lower surface 16 to space the upper surface 14 apart from the lower surface 16 in the thickness direction 't'.

The main body 12 may be a single unit including a gusset portion 20 and an adjoining portion or portions 22 connected to the gusset portion 20. Alternatively, the gusset portion 20 and adjoining portion or portions 22 may be formed separately and joined together. The gusset portion 20 is positioned along a portion of the first length L1 of the main body 12 and extends at least partially across the first width W1 of the main body 12. In one embodiment, the first length L1 extends in the length direction '1' from a first end 24 to a second end 26, and the gusset portion 20 is positioned between, and spaced from, each of the first end 24 and the second end 26. Thus, the gusset portion 20 may extend a second length L2, shorter than the first length L1. In addition, the first width W1 extends from a first side 28 to a second side 30 of the main body 12. In one embodiment, the gusset portion 20 is formed having a second width W2 extending from the first side 28 to the second side 30. Accordingly, in one embodiment, the width of the gusset portion 20, i.e., the second width W2, may be equal to the width of the main body 12, i.e., the first width W1.

The gusset portion 20 may also be formed having a second thickness T2. In one embodiment, the thickness T2 of the gusset portion 20 varies along the length L2 of the gusset portion 20. For example, the gusset portion 20 may be formed having a generally arcuate or curved profile along its length L2 such that the gusset portion 20 generally extends outwardly on the upper surface 14 relative to the adjacent portion of the padding surface 12 to define a support portion 31. Thus, the second thickness T2 of the gusset portion 20, is, on average, greater than the first thickness T1 of the adjoining portions 22 of the main body 12. In one embodiment, the gusset portion 20, at the upper surface 14, is oval or generally oval in profile when viewed in the width direction 'w'. That is, moving along the upper surface 14, in the length direction '1', an oval or generally oval profile is formed by the gusset portion 20. It is understood that the terminology "oval" and "generally oval" above refer to segments of an oval or generally oval shape, and not necessary a complete oval or generally complete oval shape. Further, it is understood that the present disclosure is not limited to this configuration, and that the gusset portion 20 may be formed having different profiles. For example, the gusset portion 20 may be formed having a circular or generally circular profile, or other arcuate shapes.

In one embodiment, the gusset portion 20 may be formed having a mesh material extending about the upper surface 14, lower surface 16 and the peripheral surfaces 18 (i.e., the peripheral surfaces at the first side 28 and the second side 30). The mesh material may be, for example, polyester or other similar material. It is understood, however, that the present disclosure is not limited to the mesh material at these portions. For example, other similar materials, for example, lightweight and breathable materials may be used instead. The material at the gusset portion 20 may be the same as, or different from, the material at the upper surface 14, lower surface 16 and peripheral surface 18 at the adjoining portions 22.

The gusset portion 20 may be formed having more than one internal channel 32, each channel 32 containing a padding material (not shown). The channels 32 may be formed by separators 34 extending in the width direction 'w' within the gusset portion 20. For example, the gusset portion 20 may include two internal separators 34 spaced apart in the length direction '1' and extending in the width direction 'w', to form three channels within the gusset portion 20. However, the present disclosure is not limited to this configuration. For example, the separators 34 may be spaced apart in the width direction 'w' and extend in the length direction '1'.

The padding material within each channel may be, for example, a fiber, either natural or synthetic, or other similar material. The separators 34 and channels 32 are configured to limit displacement of the padding material in each channel 32. Accordingly, the gusset portion 20 having the internal channels 32 may resist or limit deformation while generally maintaining the desired shape or profile at the upper surface 14.

Figure 2:
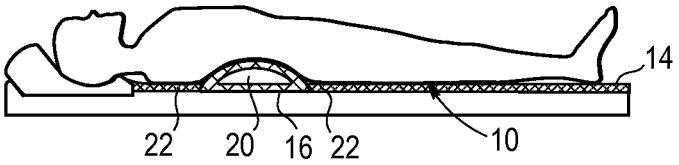
FIG. 2 is a side view of the mattress pad or the mattress topper of FIG. 1 with a user in a first position.
Figure 3:
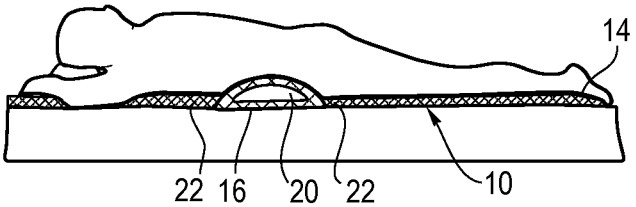
FIG. 3 is a side view of the mattress pad or the mattress topper of FIG. 1 with a user in a second position.
Figure 4:
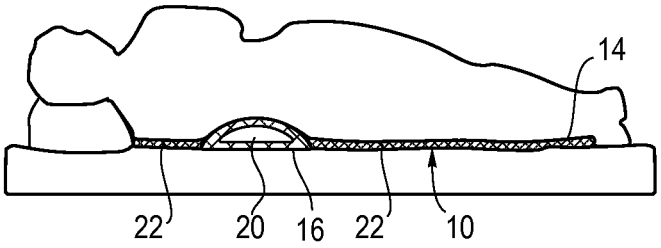
FIG. 4 is a side view of the mattress pad or the mattress topper of FIG. 1 with a user in a third position.

FIGS. 2-4 illustrate examples of a user position on the mattress pad or topper 10 described in the embodiments above. Referring to FIG. 2, in one example, a user may be in a supine position. In this position, the gusset portion 20 is configured to serve as, for example, a lower back support for the user. That is, the gusset portion may project upwardly on the upper surface 14, relative to the upper surface 14 at the adjoining portions 22 and supportingly contact the user's lower back. The profile of the gusset portion 20, for example, the generally oval profile, may be generally maintained due to the padding material being disposed in the internal channels 32 of the gusset portion 20.

Referring to FIG. 3, the user may be in a prone position. In this position, the gusset portion 20 may supportingly containing the user's abdominal region. Referring to FIG. 4, the user may be positioned in a generally lateral recumbent position. In this position, the gusset portion 20 may supportingly contact a lateral or side portion of the user's abdomen, above the user's hips, and near the user's oblique area. In this example, support from the gusset portion 20 may be useful for aligning or maintaining alignment of the user's spine.

In the embodiments above, a user may position themselves relative to a generally fixed support, i.e., the gusset portion 20. In the event the user desires to change their position, they need only adjust their position relative to the gusset portion 20, without having to further adjust the gusset portion 20. Further, as noted above, the gusset portion is configured to substantially retain its shape during use by way of internal channels 32 having padding material positioned within the channels 32 (see FIG. 1). Further still, because the gusset portion is formed around all sides by a mesh or other lightweight and/or breathable material, increased air flow through the gusset portion 20 may be recognized. Accordingly, due to the increased airflow, a comfortable temperature may be maintained between the portion of the user's body in contact with the gusset portion 20 and the gusset portion 20.

It is understood that the mattress pad or topper 10 may include depending sides configured to fit around corresponding side of a mattress (not shown). Alternatively, or in combination with the depending sides, the mattress pad or topper 10 may include a plurality of securing band configured to fit around corresponding corners of the mattress. The depending sides and the securing bands are configured to maintain the mattress pad or topper 10 in position on the mattress.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A mattress pad or topper comprising:

a main body having a length, an upper surface, a lower surface and a peripheral surface, the main body comprising:

a gusset portion having an arcuate profile at the upper surface defining a support portion; and at least one adjoining portion adjoined to the gusset portion, wherein the upper surface at the arcuate profile projects beyond the upper surface at the adjoining portion, wherein one or more of the upper surface, lower surface and peripheral surface, at the gusset portion are formed by a mesh material.

2. The mattress pad or topper of claim 1, wherein the arcuate profile is a segment of an oval.

3. The mattress pad or topper of claim 1, further comprising a plurality of internal channels formed by one or more separators extending within the gusset portion, each channel having a padding material retained therein.

4. The mattress pad or topper of claim 1, further comprising a padding material disposed in the gusset portion.

5. The mattress pad or topper of claim 1, wherein the length of the main body extends from a first end of the main body to the second end of the main body, and the gusset portion is positioned along the length of the main body and spaced from the first end and the second end.

6. A mattress pad or topper comprising:

a main body having a length, an upper surface, a lower surface and a peripheral surface, the main body comprising:

a gusset portion having an arcuate profile at the upper surface defining a support portion; and at least one adjoining portion adjoined to the gusset portion, wherein the upper surface at the arcuate profile projects beyond the upper surface at the adjoining portion, and wherein the upper surface, lower surface and peripheral surface, at the gusset portion, are formed by a mesh material.

7. The mattress pad or topper of claim 6, wherein the arcuate profile is a segment of an oval.

8. The mattress pad or topper of claim 6, further comprising a plurality of internal channels formed by one or more separators extending within the gusset portion, each channel having a padding material retained therein.

9. The mattress pad or topper of claim 6, further comprising a padding material disposed in the gusset portion.

10. The mattress pad or topper of claim 6, wherein the length of the main body extends from a first end of the main body to the second end of the main body, and the gusset portion is positioned along the length of the main body and spaced from the first end and the second end.

* * * * *